US010069199B2

(12) United States Patent
Chen et al.

(10) Patent No.: US 10,069,199 B2
(45) Date of Patent: Sep. 4, 2018

(54) ANTENNA AND RADIO FREQUENCY SIGNAL TRANSCEIVING DEVICE

(71) Applicant: Wistron NeWeb Corp., Hsinchu (TW)

(72) Inventors: Jun-Fu Chen, Hsinchu (TW); Yu-Yu Chiang, Hsinchu (TW)

(73) Assignee: Wistron NeWeb Corp., Hsinchu (TW)

( * ) Notice: Subject to any disclaimer, the term of this patent is extended or adjusted under 35 U.S.C. 154(b) by 248 days.

(21) Appl. No.: 14/938,858

(22) Filed: Nov. 12, 2015

(65) Prior Publication Data

US 2016/0352025 A1 Dec. 1, 2016

(30) Foreign Application Priority Data

Jun. 1, 2015 (TW) ..... 104117655 A

(51) Int. Cl.

| | |
|---|---|
| ***H01Q 1/38*** | (2006.01) |
| ***H01Q 1/24*** | (2006.01) |
| ***H01Q 1/48*** | (2006.01) |
| ***H01Q 5/392*** | (2015.01) |

(52) U.S. Cl.

CPC ..... *H01Q 1/38* (2013.01); *H01Q 1/243* (2013.01); *H01Q 1/48* (2013.01); *H01Q 5/392* (2015.01)

(58) Field of Classification Search

CPC ..... H01Q 1/38; H01Q 5/392
USPC ..... 343/700
See application file for complete search history.

(56) References Cited

U.S. PATENT DOCUMENTS

| | | | | |
|---|---|---|---|---|
| 7,956,812 | B2 * | 6/2011 | Chen | H01Q 1/38 343/700 MS |
| 8,779,989 | B2 | 7/2014 | Huang et al. | |
| 2008/0180333 | A1 * | 7/2008 | Martiskainen | H01Q 1/243 343/722 |

(Continued)

FOREIGN PATENT DOCUMENTS

| | | |
|---|---|---|
| CN | 102044745 | 5/2011 |
| CN | 102055061 | 5/2011 |

(Continued)

OTHER PUBLICATIONS

"Office Action of Taiwan Counterpart Application", dated Mar. 8, 2017, p. 1-p. 6.

(Continued)

*Primary Examiner* — Dameon E Levi
*Assistant Examiner* — Walter Davis
(74) *Attorney, Agent, or Firm* — JCIPRNET

(57) ABSTRACT

An antenna including an antenna structure disposed on a substrate is provided. The antenna structure includes a first radiation part, a second radiation part, a metal coupling part, a third radiation part and a feeding point. The first radiation part has a first bend, a second bend and an opening end. The first radiation part extends from a grounding point of a grounding plane and the opening end thereof is nearing the grounding plane. The second radiation part extends from a section between the first bend of the first radiation part and the grounding point. The metal coupling part is nearing the first radiation part and the second radiation part. The third radiation part is disposed between the second radiation part and the grounding plane, and extends from the metal coupling part. The feeding point is coupled to where the third radiation part and the metal coupling part connected.

20 Claims, 4 Drawing Sheets

(56) References Cited

U.S. PATENT DOCUMENTS

2011/0095949 A1* 4/2011 Wong ..... H01Q 1/243
343/702

FOREIGN PATENT DOCUMENTS

| | | |
|---|---|---|
| CN | 103078179 | 5/2013 |
| CN | 103259076 | 8/2013 |

OTHER PUBLICATIONS

"Office Action of China Counterpart Application", dated Jun. 28, 2018, p. 1-p. 12.

* cited by examiner

ANTENNA AND RADIO FREQUENCY SIGNAL TRANSCEIVING DEVICE

CROSS-REFERENCE TO RELATED APPLICATION

This application claims the priority benefit of Taiwan application serial no. 104117655, filed on Jun. 1, 2015. The entirety of the above-mentioned patent application is hereby incorporated by reference herein and made a part of this specification.

BACKGROUND OF THE INVENTION

Field of the Invention

The invention is related to an antenna and particularly to an antenna and a radio frequency signal transceiving device including said antenna.

Description of Related Art

Along with rapid changes of technology, mobile electronic devices, such as smartphone and tablet PC etc., are widely used in people's life. In general, the mobile electronic device is equipped with a wireless radio frequency signal transceiving module and a corresponding antenna structure so that the mobile electronic device is capable of transceiving wireless radio frequency signals, so as to fulfill the communication and data transmission requirements of the user. The antenna structure of the mobile electronic device needs to be set up corresponding to the frequency band and the characteristics of the transceiving radio frequency signal. Therefore, the mobile electronic device may include one or more antennas for transceiving the corresponding radio frequency signal.

The size of the antenna is limited by the wavelength of the transceiving radio frequency signal, which is not easy to increase or decrease. In addition, designer of the mobile electronic device also has to dispose a clearance area corresponding to the size of the antenna, so that the transceiving capability of the antenna would not be affected by the other elements in the mobile electronic device. However, in order to be carried easily, the mobile electronic device is designed to be smaller, thinner, and lighter. Therefore, the problem of disposing the antenna needs to be further considered. For example, how to configure an integrated antenna capable of transceiving radio frequency signals at a plurality of frequency bands inside a certain space is a problem that people skilled in the art need to solve.

SUMMARY OF THE INVENTION

The invention provides an antenna which has a miniaturized antenna structure and further satisfies the requirement that the antenna is operated in a wide variety of bands.

In one aspect of the invention, an antenna includes an antenna structure which is disposed on the substrate. The antenna structure includes a grounding plane, a first radiation part, a second radiation part, a metal coupling part, a third radiation part and a feeding point. The grounding plane includes a grounding point. The first radiation part has a first bend, a second bend and an opening end. The first radiation part extends from the grounding point and the opening end thereof is nearing the grounding plane. The second radiation part extends from a section between the first bend of the first radiation part and the grounding point. The metal coupling part is nearing the grounding plane, the first radiation part and the second radiation part. The third radiation part is disposed between the second radiation part and the grounding plane, and extends from the metal coupling part. The feeding point is coupled to where the third radiation part and the metal coupling part connected. The antenna is configured to transceive a plurality of radio frequency signals in a plurality of frequency bands.

In another aspect of the invention, a radio frequency signal transceiving device includes a radio frequency signal processing module and the antenna structure disposed on the substrate. The antenna structure includes a grounding plane, a first radiation part, a second radiation part, a metal coupling part, a third radiation part and a feeding point. The grounding plane includes a grounding point. The first radiation part has a first bend, a second bend and an opening end. The first radiation part extends from the grounding point and the opening end thereof is nearing the grounding plane. The second radiation part extends from a section between the first bend of the first radiation part and the grounding point. The metal coupling part is nearing the grounding plane, the first radiation part and the second radiation part. The third radiation part is disposed between the second radiation part and the grounding plane, and extends from the metal coupling part. The feeding point is coupled to where the third radiation part and the metal coupling part connected. Wherein the radio frequency signal processing module is coupled to the antenna structure, and the radio frequency signal processing module transceives a plurality of radio frequency signals at a plurality of frequency bands by using the antenna structure via the feeding point.

Based on the above, the invention provides an antenna and a radio frequency signal transceiving device including said antenna, and the radio frequency signal transceiving device can transceive a plurality of radio frequency signals at a plurality of frequency bands. Under the premise that the antenna structure does not affect the efficiency of the antenna, the design goal that the antenna structure is miniaturized is achieved.

In order to make the aforementioned and other features and advantages of the invention more comprehensible, embodiments accompanying figures are described in detail belows.

DESCRIPTION OF THE EMBODIMENTS

Figure 1:
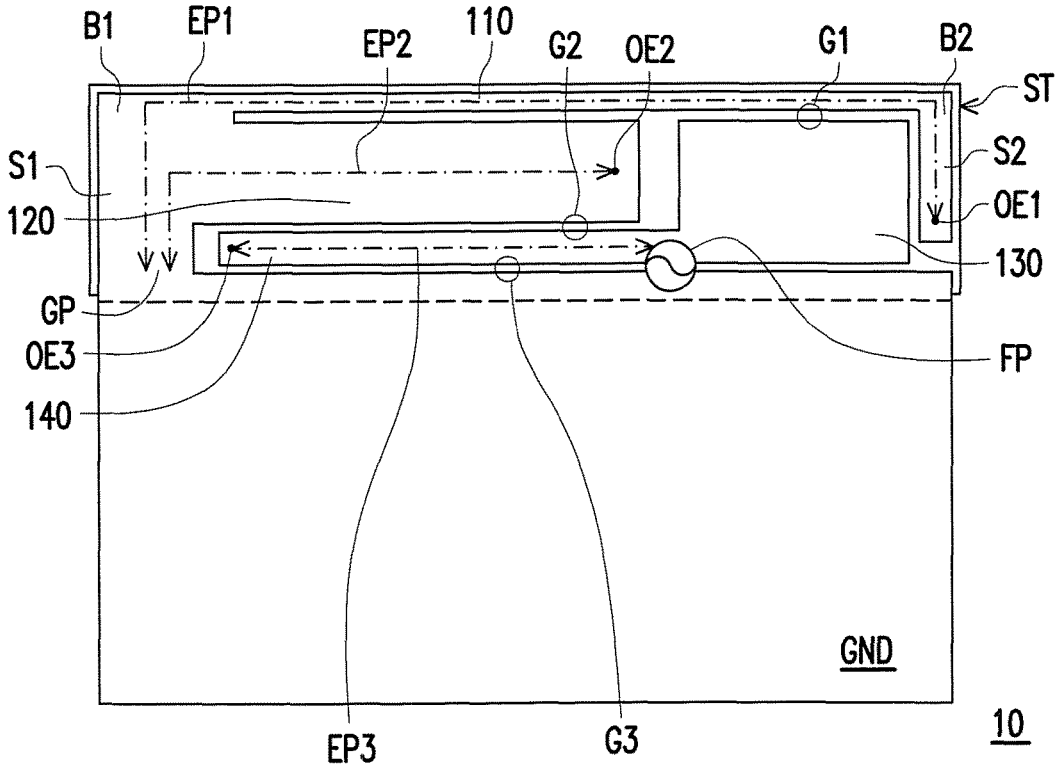
FIG. 1 is a structure schematic diagram illustrating an antenna according to an embodiment of the invention.

FIG. 1 is a structure schematic diagram illustrating an antenna according to an embodiment of the present invention. Referring to FIG. 1, in the present embodiment, the antenna includes an antenna structure 10 which is disposed on a substrate ST. The antenna structure 10 includes a grounding plane GND, a first radiation part 110, a second radiation part 120, a metal coupling part 130, a third radiation part 140, and a feeding point FP. The grounding plane GND includes a grounding point GP. In the present embodiment, the first radiation part 110 has a ⊓ shape and has a first bend B1, a second bend B2, and an opening end OE1. The first radiation part 110 extends from the grounding point GP, and the opening end OE1 of the first radiation part 110 is nearing the grounding plane GND.

The second radiation part 120 has an opening end OE2 and the opening end OE2 extends from a section between the first bend B1 of the first radiation part 110 and the grounding point GP (i.e., the first section S1 of the first radiation part 110) to a section between the second bend B2 of the first radiation part 110 and the opening end OE1 (i.e., the second section S2 of the first radiation part 110). The metal coupling part 130 is nearing the grounding plane GND, the second bend B2 and the opening end OE1 of the first radiation part 110, and the second radiation part 120 (specifically, the opening end OE2 of the second radiation part 120). The third radiation part 140 has an opening end OE3, and the third radiation part 140 is disposed between the second radiation part 120 and the grounding plane GND, and extends from the metal coupling part 130 to the section between the first bend B1 of the first radiation part 110 and the grounding point GP (i.e., the first section S1 of the first radiation part 110). The feeding point FP is coupled to where the third radiation part 140 and the metal coupling part 130 connected.

Figure 2:
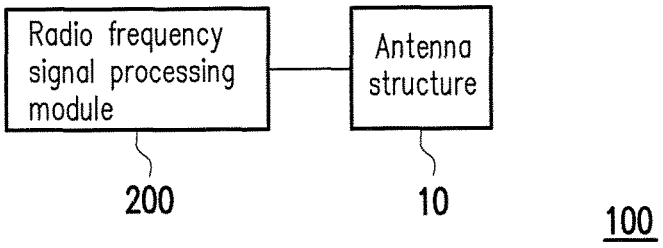
FIG. 2 is a functional block diagram illustrating a radio frequency signal transceiving device according to an embodiment of the invention.

The antenna could be configured in a radio frequency signal transceiving device, and the radio frequency signal transceiving device may transceiver a plurality of radio frequency signals at a plurality of frequency bands through the antenna structure 10 via the feeding point FP. For example, FIG. 2 is a functional block diagram illustrating a radio frequency signal transceiving device according to an embodiment of the invention. Referring to FIG. 1 and FIG. 2, a radio frequency signal transceiving device 100 includes the above-shown antenna, and further includes a radio frequency signal processing module 200 which is coupled to the antenna structure 10 via a coaxial cable (for example, the core of the coaxial cable is connected to the feeding point FP, and the outer braid is connected to grounding plane GND), and the radio frequency signal processing module 200 can feed-in/receive the radio frequency signals at different frequency bands via the coaxial cable which is connected to the antenna structure 10. For example, the frequency bands include a first frequency band, a second frequency band, and a third frequency band, which respectively are a low frequency band, a medium frequency band, and a high frequency band, wherein the low frequency band, the medium frequency band, and the high frequency band are not overlapped to each other. In addition, the radio frequency signal transceiving device 100 can use the modes excited by a portion of the antenna structure 10 to transceiver the radio frequency signals corresponding to the first frequency band, the second frequency band, and the third frequency band, respectively.

Specifically, to feed-in/receive a first radio frequency signal at the first frequency band, a first mode is excited by coupling the third radiation part 140 to the first radiation part 110 for transceiving the first radio frequency signal according to a coupled monopole antenna principle, wherein the length of the first radiation part (corresponding to the length of a ⊓-shaped first excitation path EP1 at the first mode) is smaller than one fourth of the wavelength of the first radio frequency signal.

To feed-in/receive a second radio frequency signal at the second frequency band, a second mode is excited by coupling the third radiation part 140 to the second radiation part 120 for transceiving the first radio frequency signal according to a coupled monopole antenna principle. The length of a second excitation path EP2 at the second mode (the length of the L-shaped second excitation path EP2 from the opening end OE2 to the grounding point GP) is smaller than one fourth of the wavelength of the second radio frequency signal.

Similarly, to feed-in/receive a third radio frequency signal at the third frequency band via the feeding point FP between the metal coupling part 130 and the third radiation part 140, the antenna structure 10 uses the feeding point FP to excite a third mode for transceiving the third radio frequency signal according to the coupled monopole antenna principle. Wherein, the length of a third excitation path EP3 corresponding to the third mode (from the opening end OE3 of the third radiation part 140 to the feeding point FP) is smaller than one fourth of a wavelength of the third radio frequency signal.

In an embodiment of the present invention, the first frequency band is set from 790 MHz to 960 MHz, the second frequency band is set from 1710 MHz to 2170 MHz, and the third frequency band is set between 2500 MHz to 2700 MHz. The above-mentioned frequency bands can cover, for example, the frequency band of the long term evolution (LTE) standard of the fourth generation wireless communication standard, and the frequency band of the global system for mobile (GSM) of the second and the third generation wireless communication standard. Therefore, the radio frequency signal processing module of the radio frequency signal transceiving device can further transmits and receives radio frequency signals, which conform to the above-mentioned mobile communication standard, through the antenna structure 10.

On the other hand, because of the arrangement between the metal coupling part 130 and each radiation part in the antenna structure 10, the first excitation path EP1, the second excitation path EP2, and the third excitation path EP3 all are smaller than one fourth or even approximate to one sixth of the wavelengths of the first radio frequency signal, the second radio frequency signal, the third radio frequency signal, respectively. Each of gaps exist between the metal coupling part 130 and each of the radiation parts in the antenna structure 10 could be used to adjust the impedance matching value, the operating frequency and/or the length of the excitation paths EP1-EP3.

For example, in the present embodiment, a first gap G1 exists between the metal coupling part 130 and the first radiation part 110, a second gap G2 exists between the third radiation part 140 and the second radiation part 120, and a third gap G3 exists between the third radiation part 140 and the grounding plane GND. In the present embodiment, the width of the first gap G1 could be set between 0.3 mm and 1.3 mm. The width of the second gap G2 and the third gap G3 could be respectively set between 0.5 mm and 1 mm With these settings, the length of the first excitation path EP1, the second excitation path EP2, and the third excitation path EP3 could be set approximately to one sixth of the wavelength of the corresponding radio frequency signals while maintaining the antenna efficiency.

Figure 3:
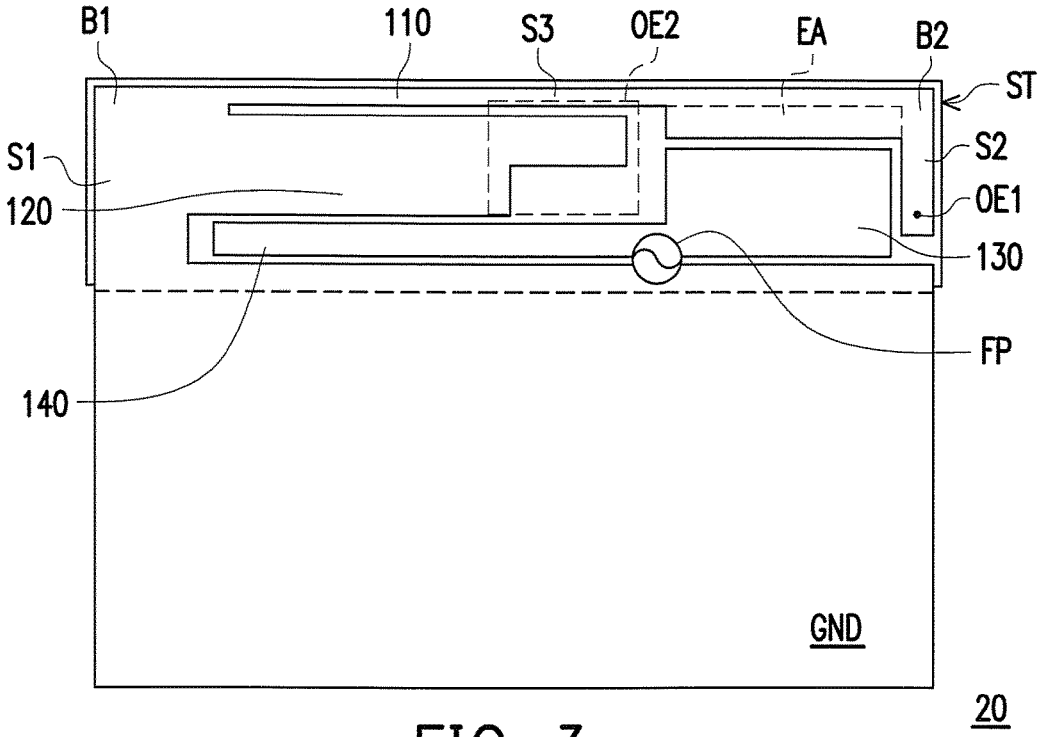
FIG. 3 is a structure schematic diagram illustrating an antenna according to an embodiment of the invention.

FIG. 3 is a structure schematic diagram illustrating an antenna according to an embodiment of the present invention. The arrangement of each element of the antenna structure 20 of the embodiment in FIG. 3 can reference to the embodiment in FIG. 1, which is omitted herein. One of the differences between the embodiment shown in FIG. 3 and the embodiment shown in FIG. 1 is that the opening end OE2 of the second radiation part 120 has a ladder-shaped configuration. In the present embodiment, the ladder-shaped opening end OE2 of the second radiation part 120 could concentrates energy while transceiving the radio frequency signal which has a lower frequency in the second frequency band corresponding to the second radiation part 120 so that the antenna efficiency could be improved thereby. For example, the second frequency band is from 1710 MHz to 2170 MHz approximately, by disposing the opening end OE2 of the second radiation part 120 as shown in the present embodiment, the antenna structure 20 could have better performance while transceiving the radio frequency signal with the center frequency close to 1710 MHz.

Another difference between the embodiment in FIG. 3 and the embodiment in FIG. 1 is that a third section S3 of the first radiation part 110 (the section between the bend B1 of the first radiation part 110 and the second bend B2) is not a section having a constant width. More specifically, the width of a portion near to the metal coupling part 130 of the third section S3 of the first radiation part 110 is wider than the width of the other portion of the third section S3 of the first radiation part 110 because an extended area EA is added to the portion near to the metal coupling part 130 of the third section S3 of the first radiation part 110. The portion added to the third section S3 (the extended area EA) is closer to the opening end OE1 of the first radiation part 110, besides that the impedance matching could be adjusted and the bandwidth of the first frequency band corresponding to the first radiation part 110 could be increased, such configuration could also make the antenna structure 20 having better performance while transceiving the radio frequency signal with center frequency close to the lower frequency part of the first frequency band, similarly to the configuration of the opening end OE2 of the second radiation part 120.

Figure 4A:
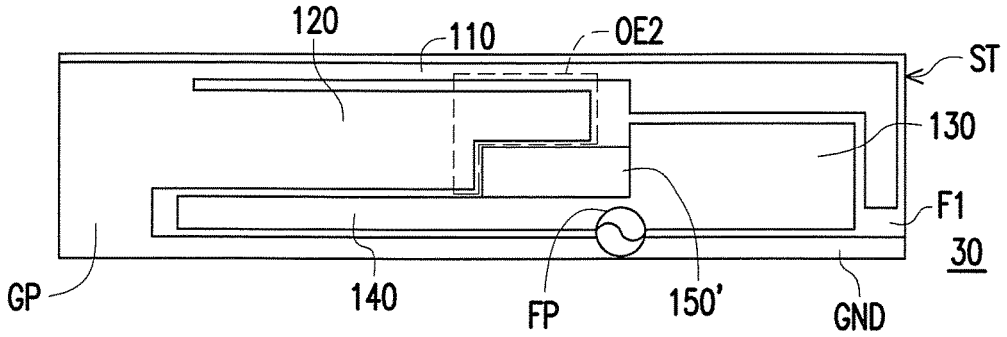
FIG. 4A to FIG. 4B are structure schematic diagrams illustrating an antenna according to an embodiment of the invention.
Figure 4B:
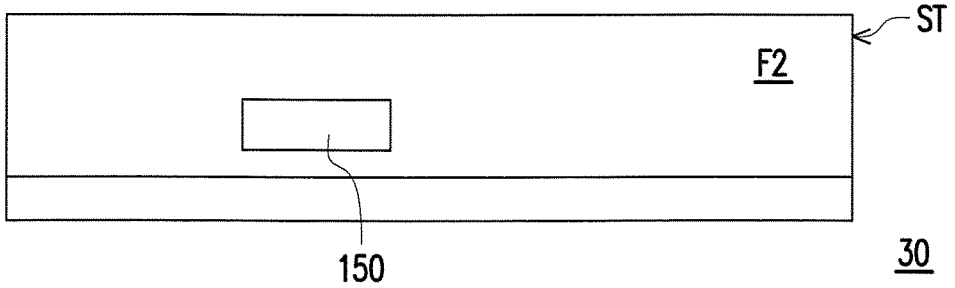

FIG. 4A to FIG. 4B are structure schematic diagrams illustrating an antenna according to an embodiment of the present invention. In the present embodiment, elements of the antenna structure 30 are disposed on the first surface F1 and the second surface F2 of the substrate ST. FIG. 4A is a schematic diagram illustrating a portion of an antenna structure 30 disposed on the first surface F1 of the substrate ST according to an embodiment of the present invention. Herein, the first radiation part 110, the second radiation part 120, the third radiation part 140, the metal coupling part 130, and the grounding plane GND of the antenna structure 30 are disposed on the first surface F1 of the substrate ST. In addition, the arrangement of the first radiation part 110, the second radiation part 120, the third radiation part 140, the metal coupling part 130, and the grounding plane GND of the antenna structure 30 on the first surface F1 of the substrate ST can reference to the embodiment in FIG. 2, which is omitted herein.

FIG. 4B is a schematic diagram illustrating a portion of the antenna structure 30 disposed on the second surface F2 of the substrate ST according to an embodiment of the present invention. The difference between the present embodiment and the embodiment in FIG. 2 is that the antenna structure 30 further includes a fourth radiation part 150 which is disposed on the second surface F2 of the substrate ST. Wherein, as shown in FIG. 4A, the orthogonal projection 150' of the fourth radiation part 150 on the first surface F1 of the substrate ST are connected to the metal coupling part 130 and the third radiation part 140, and near the second radiation part 120. Also, a constant gap exists between the orthogonal projection 150' and the second radiation part 120. In the present embodiment, when the first mode, the second mode, or the third mode is excited by the antenna structure 30, the energy would also be coupled to the fourth radiation part 150. Specifically, when the second mode is excited, the third radiation part 140 would be coupled to the second radiation part 120 and the fourth radiation part 150 to excite the second mode for transceiving the second radio frequency signal according to a coupled monopole antenna principle, and the fourth radiation part 150 could increase the radiation performance of the second mode efficiently.

Therefore, the size of the fourth radiation part 150 and the width of the gap between the fourth radiation part 150 and the second radiation part 120 could also be used to adjust the operating frequency of the first mode, the second mode, and the third mode (mainly corresponding to the second mode of the second radiation part 120), and to adjust the impedance matching value of the antenna structure 30.

Figure 5:
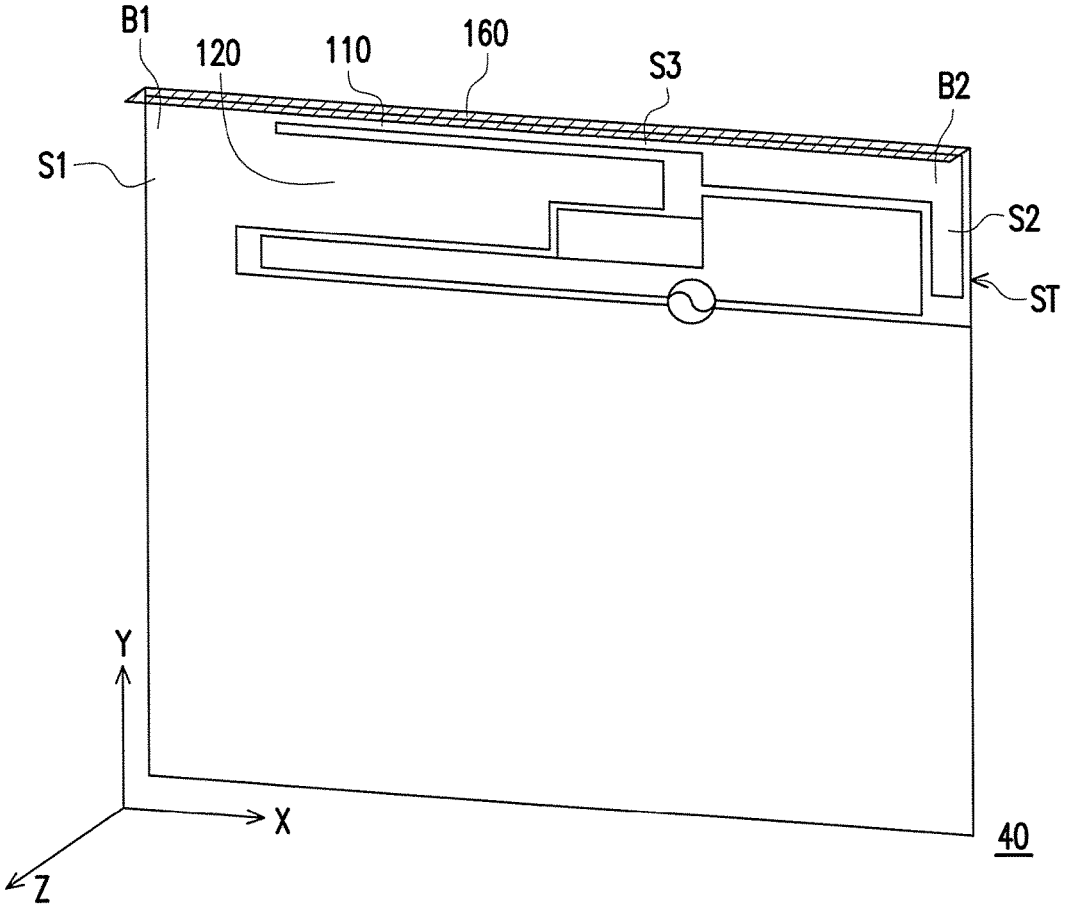
FIG. 5 is a structure schematic diagram illustrating an antenna according to an embodiment of the invention.

FIG. 5 is a structure schematic diagram illustrating an antenna according to an embodiment of the present invention. Wherein, the arrangement of each element of the antenna structure 40 of the embodiment in FIG. 5 can reference to the embodiment in FIG. 4A and FIG. 4B, but the invention is not limited thereto. The difference between the embodiment shown in FIGS. 4A, 4B and the embodiment shown in FIG. 5 is that the antenna structure 40 further includes an extended radiation part 160 which is extended along a direction perpendicular to the substrate ST from an outer side of the third section S3 of the first radiation part 110 (for example, the substrate ST is parallel to the XY plane, and the Z axis direction would be the direction perpendicular to the substrate ST). The outer side of the third section S3 of the first radiation part 110 is away from a side of the grounding plan GND. The extended radiation part 160 could be used to increase the frequency band, more particularly, could be used to increase the bandwidth of the operating frequency band corresponding to the first mode of the first radiation part 110. Due to the connecting relationship between the extended radiation part 160 and the first radiation part 110, the extended radiation part 160 could also be used to adjust the impedance matching value. In the present embodiment, as shown in FIG. 5, the length of the extended radiation part 160 is the same as the length of the third section S3 of the first radiation part 110, and a edge of the third section S3 of the first radiation part 110 is connected to the extended radiation part 160. The extended radiation part 160 in the antenna could be set to meet the actual requirements (such as, the requirement about the width and the impedance match or the requirement about exterior design of the radio frequency signal transceiving device) by adjusting the length (for example, smaller than or equal to the length of the third section S3 of the first radiation part 110) or the height (the width extended along a direction perpendicular to the substrate ST, the Z axis direction, of the extended radiation part 160) of the extended radiation part 160.

Figure 6:
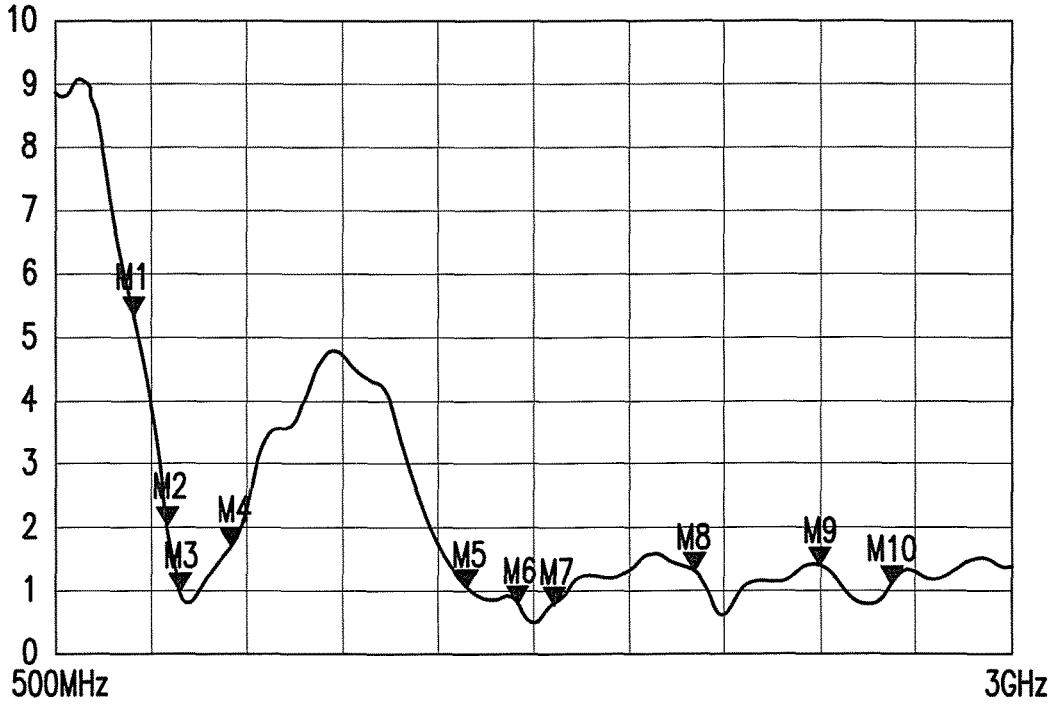
FIG. 6 is a diagram illustrating voltage standing wave ratio of an antenna according to the embodiment in FIG. 3.

FIG. 6 is a diagram illustrating voltage standing wave ratio (VSWR) of an antenna according to the embodiment in FIG. 3. In the present embodiment, the first frequency band is set from 790 MHz to 960 MHz (between the observation points M2-M4), the second frequency band is set from 1710 MHz to 2170 MHz (between the observation points M5-M8), the third frequency band is set between 2500 MHz to 2700 MHz (between the observation points M9-M10). Referring to FIG. 6, within the first frequency band, the second frequency band, and the third frequency band, the voltage standing wave ratio is smaller than 5, most of the section is smaller than 3, so that the antenna structure disclosed in the present invention may have a good impedance matching ability and a good signal transceiving performance. Considering the VSWR of the antenna structure in the embodiment in FIG. 4A and FIG. 4B, the VSWR performance of the low frequency section of the second frequency band (corresponding to the surroundings of the observation points M5, M6) is better than the embodiment in FIG. 3. If comparing the VSWRs corresponding the antenna structure shown in the embodiment in FIGS. 4A-4B and with the VSWRs of the antenna structure 40 shown in the embodiment in FIG. 5, besides a better performance at the surroundings of the observation points M5, M6 as mentioned above, the VSWR performance corresponding to the first frequency band (between the observation points M2~M4) of the antenna structure 40 shown in the embodiment in FIG. 5 would also be superior to the VSWRs corresponding the antenna structure shown in in FIG. 3.

In summary, the invention provides an antenna and a radio frequency signal transceiving device including said antenna, using the monopole antenna principle and mutually coupling relationship between each of radiation parts and the metal coupling part in the antenna structure while exciting, the area of the antenna structure can be smaller than the area of the conventional antenna structure used for transceiving signals at the same frequency band, not only the requirement of operating the antenna multiple bands is satisfied, but the goals of antenna miniaturization and good antenna efficiency are also achieved.

Although the invention has been disclosed with reference to the aforesaid embodiments, they are not intended to limit the invention. It will be apparent to one of ordinary skill in the art that modifications and variations to the described embodiments may be made without departing from the spirit and the scope of the invention. Accordingly, the scope of the invention will be defined by the attached claims and not by the above detailed descriptions.

What is claimed is:

1. An antenna, comprising:

a substrate;

an antenna structure, disposed on the substrate, comprising:

a grounding plane, comprising a grounding point;

a first radiation part, having a first bend, a second bend and an opening end, wherein the first radiation part extends from the grounding point and the opening end thereof is spaced from the grounding plane by a first distance;

a second radiation part, extending from a first section between the first bend of the first radiation part and the grounding point to a second section between the second bend of the first radiation part and the opening end;

a metal coupling part, locating in an area surrounded by the grounding plane, the second bend and the opening end of the first radiation part, and the second radiation part, wherein the second radiation part is disposed between the first section and the metal coupling part, and the metal coupling part is disposed between the second radiation part and the second section; and a third radiation part, disposed between the second radiation part and the grounding plane, and extends from the metal coupling part to the first section; and a feeding point, coupled to where the third radiation part and the metal coupling part are connected, wherein the antenna is configured to transceive a plurality of radio frequency signals respectively in a plurality of frequency bands.

2. The antenna as recited in claim 1, wherein:

the frequency bands comprise a first frequency band, and the radio frequency signals comprise a first radio frequency signal at the first frequency band; and a first mode is excited by coupling the third radiation part to the first radiation part for transceiving the first radio frequency signal according to a coupled monopole antenna principle, wherein a length of a first excitation path in the first radiation part is smaller than one fourth of a wavelength of the first radio frequency signal.

3. The antenna as recited in claim 1, wherein:

the second radiation part has an opening end spaced from the metal coupling part by a second distance;

the frequency bands comprise a second frequency band, and the radio frequency signals comprise a second radio frequency signal at the second frequency band; and a second mode is excited by coupling the third radiation part to the second radiation part for transceiving the second radio frequency signal according to a coupled monopole antenna principle, wherein a length of a second excitation path from the opening end of the second radiation part to the grounding point is smaller than one fourth of a wavelength of the second radio frequency signal.

4. The antenna as recited in claim 3, wherein:

the opening end of the second radiation part has a ladder shape.

5. The antenna as recited in claim 4, wherein:

the substrate comprises a first surface and a second surface, and the first radiation part, the second radiation part, the third radiation part, the metal coupling part, and the grounding plane of the antenna structure are disposed on the first surface of the substrate; and the antenna structure further comprises:

a fourth radiation part, disposed on the second surface of the substrate, wherein an orthogonal projection of the fourth radiation part on the first surface of the substrate is connected to the metal coupling part and the third radiation part, and is spaced from the second radiation part by a third distance.

6. The antenna as recited in claim 5, wherein:

the second mode is excited by coupling the third radiation part to the second radiation part for transceiving the second radio frequency signal according to a coupled monopole antenna principle.

7. The antenna as recited in claim 1, wherein:

the third radiation part has an opening end, spaced from the first section by a fourth distance;

the frequency bands comprise a third frequency band, and the radio frequency signals comprise a third radio frequency signal at the third frequency band; and a third mode is excited by using the feeding point to feed-in the third radiation part for transceiving the third radio frequency signal according to a coupled monopole antenna principle, wherein a length of a third excitation path from the opening end of the third radiation part to the feeding point is smaller than one fourth of a wavelength of the third radio frequency signal.

8. The antenna as recited in claim 1, wherein:

a first gap exists between the metal coupling part and the first radiation part; and a width of the first gap is between 0.3 mm and 1.3 mm.

9. The antenna as recited in claim 1, wherein:

a second gap exists between the third radiation part and the second radiation part; and a third gap exists between the third radiation part and the grounding plane, wherein, a width of the second gap and the third gap is between 0.5 mm and 1 mm.

10. The antenna as recited in claim 1, wherein the antenna structure further comprises:

an extended radiation part, extended along a direction perpendicular to the substrate from a side away from the grounding plane of a first section of the first radiation part, wherein the first section of the first radiation part is located between the first bend and the second bend.

11. A radio frequency signal transceiving device, comprising:

a radio frequency signal processing module;

a substrate;

an antenna structure, disposed on the substrate, comprising:

a grounding plane, comprising a grounding point;

a first radiation part, having a first bend, a second bend and an opening end, wherein the first radiation part extends from the grounding point and the opening end of the first radiation part is spaced from the grounding plane by a first distance;

a second radiation part, extending from a first section between the first bend of the first radiation part and the grounding point to a second section between the second bend of the first radiation part and the opening end;

a metal coupling part, locating in an area surrounded by the grounding plane, the second bend and the opening end of the first radiation part, and the second radiation part, wherein the second radiation part is disposed between the first section and the metal coupling part, and the metal coupling part is disposed between the second radiation part and the second section; and a third radiation part, disposed between the second radiation part and the grounding plane, and extends from the metal coupling part to the first section; and a feeding point, coupled to where the third radiation part and the metal coupling part are connected, wherein the radio frequency signal processing module is coupled to the antenna structure, and the radio frequency signal processing module transceives a plurality of radio frequency signals at a plurality of frequency bands by using the antenna structure via the feeding point.

12. The radio frequency signal transceiving device as recited in claim 11, wherein:

the frequency bands comprise a first frequency band, and the radio frequency signals comprise a first radio frequency signal at the first frequency band; and a first mode is excited by coupling the third radiation part to the first radiation part for transceiving the first radio frequency signal according to a coupled monopole antenna principle, wherein a length of a first excitation path in the first radiation part is smaller than one fourth of a wavelength of the first radio frequency signal.

13. The radio frequency signal transceiving device as recited in claim 11, wherein:

the second radiation part has an opening end spaced from the metal coupling part by a second distance;

the frequency bands comprise a second frequency band, and the radio frequency signals comprise a second radio frequency signal at the second frequency band; and a second mode is excited by coupling the third radiation part to the second radiation part for transceiving the second radio frequency signal according to a coupled monopole antenna principle, wherein a length of a second excitation path from the opening end of the second radiation part to the grounding point is smaller than one fourth of a wavelength of the second radio frequency signal.

14. The radio frequency signal transceiving device as recited in claim 13, wherein:

the opening end of the second radiation part has a ladder shape.

15. The radio frequency signal transceiving device as recited in claim 14, wherein:

the substrate comprises a first surface and a second surface, and the first radiation part, the second radiation part, the third radiation part, the metal coupling part, and the grounding plane of the antenna structure are disposed on the first surface the substrate; and the antenna structure further comprises:

a fourth radiation part, disposed on the second surface of the substrate, wherein an orthogonal projection of the fourth radiation part on the first surface of the substrate is connected to the metal coupling part and the third radiation part, and is spaced from the second radiation part by a third distance.

16. The radio frequency signal transceiving device as recited in claim 15, wherein:

the second mode is excited by coupling the third radiation part to the second radiation part and the fourth radiation part for transceiving the second radio frequency signal according to a coupled monopole antenna principle.

17. The radio frequency signal transceiving device as recited in claim 11, wherein:

the third radiation part has an opening end, spaced from the first section by a fourth distance;

the frequency bands comprise a third frequency band, and the radio frequency signals comprise a third radio frequency signal at the third frequency band; and a third mode is excited by using the feeding point to feed-in the third radiation part for transceiving the third radio frequency signal according to a coupled monopole antenna principle, wherein a length of a third excitation path from the opening end of the third radiation part to the feeding point is smaller than one fourth of a wavelength of the third radio frequency signal.

18. The radio frequency signal transceiving device as recited in claim 11, wherein:

a first gap exists between the metal coupling part and the first radiation part; and a width of the first gap is between 0.3 mm and 1.3 mm.

19. The radio frequency signal transceiving device as recited in claim 11, wherein:

a second gap exists between the third radiation part and the second radiation part; and a third gap exists between the third radiation part and the grounding plane, wherein a width of the second gap and the third gap is between 0.5 mm and 1 mm.

20. The radio frequency signal transceiving device as recited in claim 11, wherein the antenna structure further comprises:

an extended radiation part, extended along a direction perpendicular to the substrate from a side away from the grounding plane of a first section of the first radiation part, wherein the first section of the first radiation part is located between the first bend and the second bend.

* * * * *